US005146230A

United States Patent [19]

Hules

[11] Patent Number: 5,146,230

[45] Date of Patent: Sep. 8, 1992

[54] ELECTROMAGNETIC BEAM SYSTEM WITH SWITCHABLE ACTIVE TRANSMIT/RECEIVE MODULES

[75] Inventor: Joseph C. Hules, Agoura, Calif.

[73] Assignee: ITT Corporation, New York, N.Y.

[21] Appl. No.: 863,350

[22] Filed: Mar. 31, 1992

Related U.S. Application Data

[63] Continuation of Ser. No. 654,265, Feb. 11, 1991, abandoned.

[51] Int. Cl.[5] ..... H01Q 3/22

[52] U.S. Cl. ..... 342/374; 342/372

[58] Field of Search ..... 342/372, 374

[56] References Cited

U.S. PATENT DOCUMENTS

| | | | |
|---|---|---|---|
| 3,530,485 | 9/1970 | Radford | 342/372 |
| 3,964,066 | 6/1976 | Nemit | 342/372 |
| 4,124,852 | 11/1978 | Steudel | 342/374 |
| 4,277,787 | 7/1981 | King . | |
| 4,451,831 | 5/1984 | Stangel et al. . | |
| 4,580,140 | 4/1986 | Cheston | 342/372 |
| 4,766,438 | 8/1988 | Tang . | |
| 4,791,421 | 12/1988 | Morse et al. | 342/374 X |
| 4,806,944 | 2/1989 | Jacomb-Hood . | |
| 4,811,032 | 3/1989 | Boksberger . | |

OTHER PUBLICATIONS

"Conformal and Low-Profile Arrays", *Antenna Engineering Handbook,* 2nd Editional, Richard C. Johnson and Henry Jasik, Editors, McGraw-Hill Book Co., New York 1984, pp. 21-12-21-21.

D. E. Meharry et al., "6 to 18 GHz Transmit/Receive Modules for Multifunction Phased Arrays", 1989 *IEEE MIT-S Digest,* pp. 115-118.

George Skahill et al., "A New Technique for Feeding a Cylindrical Array", *IEEE Transactions on Antennas and Propagation,* Mar. 1975, pp. 253-256.

G. Seehausen, "Feed System for Spherical Antenna Arrays With Amplitude Control", pp. 334-339.

*Primary Examiner*—Mark Hellner

*Attorney, Agent, or Firm*—Koppel & Jacobs

[57] ABSTRACT

A transmission/reception system for electromagnetic signals such as radar operates with a non-lineaar/non-planar array of passive radiating/reception elements, and a smaller number of active transmission/reception (T/R) modules which generate and receive coded or uncoded RF power and/or electromagnetic signals within a desired portion of the electromagnetic spectrum. The active T/R modules are switched between respective pluralities of the passive radiating/reception elements, so that each module is connected to only one element at a time. The switching is controlled so that the T/R modules are connected to desired patterns of passive elements in succession. The passive elements are arranged in a plurality of sectors, with the active T/R modules each connected to a respective single passive element in each sector.

19 Claims, 6 Drawing Sheets

ELECTROMAGNETIC BEAM SYSTEM WITH SWITCHABLE ACTIVE TRANSMIT/RECEIVE MODULES

This is a continuation of copending application Ser. No. 654,265, filed on Feb. 11, 1991 now abandoned.

BACKGROUND OF THE INVENTION

1. Field of the Invention

This invention relates to electromagnetic beam formation and transmission/reception systems, and more particularly to radar systems employing active transmit/receive (T/R) modules for localized transmission and reception functions.

2. Description of the Prior Art

To achieve a radar system with a high volumetric coverage without mechanically moving the antenna, antenna arrays in the past have been designed in circular, cylindrical and spherical configurations. Many of these configurations have used antenna feed systems, with a centralized RF power source and various types of constrained feed or space feed power distribution schemes. Examples of centralized feed systems are described in *Antenna Engineering Handbook*, 2nd Edition, Richard C. Johnson, Henry Jasik, Editors McGraw-Hill Book Co., New York, 1984, pages 21-12 through 21-21.

The centralized feed systems all require some way to efficiently distribute the RF power to the antenna radiating elements. For a constrained feed system, dividers and combiners are required that can introduce undesirable inter-element interference and losses. With space feed systems, difficult problems arise from a lack of aperture efficiency, and interference such as jamming and spurious radiation. With either approach, the entire system is subject to catastrophic failure in the event of a loss of the centralized power source.

More recently, active T/R modules have been developed that make it possible to generate RF power directly at the antenna element, to set relative phase relationships between the elements, and to perform preamplification of the received signal, all within the active T/R module. Locating the modules at each antenna element in the antenna array simplifies the problem of activating non-linear/non-planar array configurations without a central RF power source.

Active T/R module arrays have low RF losses, a lower vulnerability to interference, and distributed rather than centralized RF power generation. However, the need to place an active T/R module at each element of the antenna array adds significantly to the production cost, and also to the weight, of a radar system that uses this type of active array. Cost and weight penalties are incurred even if only a portion of the array is activated at any given time.

SUMMARY OF THE INVENTION

The present invention seeks to provide a new type of electromagnetic transmission/reception system, applicable to both radar and other areas of the electromagnetic spectrum, that retains the advantages of active T/R module arrays over centralized power source systems, and yet substantially reduces the weight and cost penalties associated with active T/R modules. The system is applicable to non-linear/non-planar arrays, and provides non-mechanical beam positioning with either (or both) selectable antenna element activation and array phase scanning.

These goals are achieved with a system that relies upon active T/R modules for electromagnetic power generation, but has substantially fewer T/R modules than the number of separate antenna elements in the system. Each of the active T/R modules is connected to a respective plurality of passive radiating/reception antenna elements. A switching mechanism is provided to control the connection of each active T/R module to its respective passive antenna elements, so that the module is connected to only one antenna element at a time. The switches are controlled so that the active T/R modules are connected to desired patterns of passive antenna elements.

The antenna elements are preferably arranged in a plurality of sectors, with the switches connecting each active T/R module to an antenna element in only one sector at a time. In a particular embodiment, the passive antenna elements and their respective active T/R modules are arranged in alternating layers. In an annular layered configuration, the antenna elements and active T/R modules are positioned along the outer portions of their respective layers, with their connecting leads located in the interior portions of the layers. The switch control means are operated to connect the active T/R modules with successive patterns of mutually adjacent antenna elements to produce beams with desired directionality and phase relationships.

These and other features and advantages of the invention will be apparent to those skilled in the art from the following detailed description, taken together with the accompanying drawings, in which:

DESCRIPTION OF PREFERRED EMBODIMENTS

The present invention is intended in the first instance for non-linear/non-planar radar arrays used to generate and receive either coded or uncoded RF power signals, but is also applicable to beam generation and reception in other areas of the electromagnetic spectrum. It uses active T/R modules to avoid the problems of a totally centralized RF power source, but incorporates a generalized switching scheme to substantially reduce the number of active T/R modules required, thereby saving considerable cost and weight. It also provides non-mechanical beam positioning with either selectable antenna element activation or array phase scanning, or both. The number of active T/R modules required can be as few as one-third the number of passive antenna elements, or even less.

Figure 1:
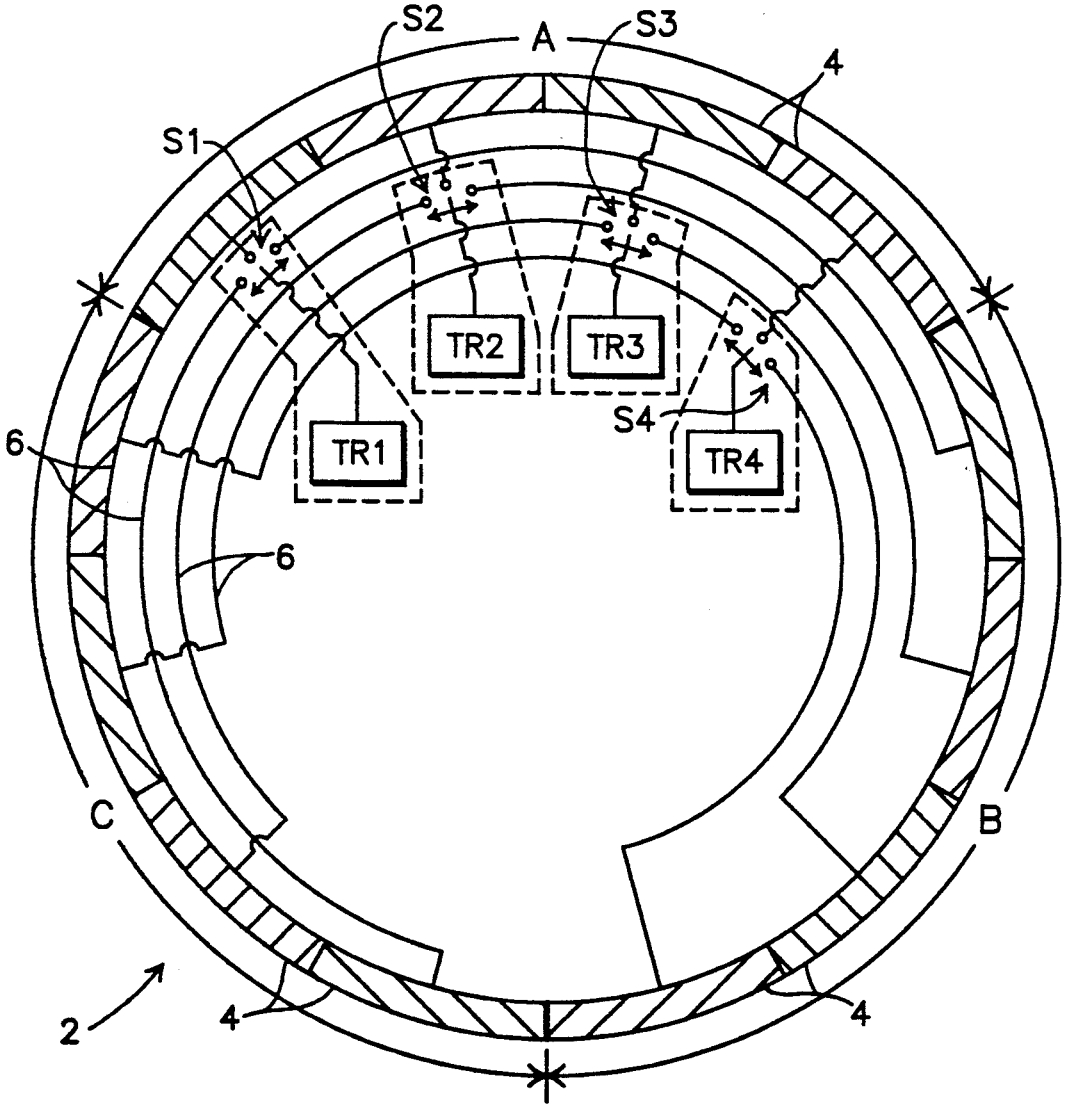
FIG. 1 is a schematic diagram showing a switching scheme for a simplified antenna array using the invention.

A simplified radar system is shown in FIG. 1 for purposes of illustrating the principals of the invention. A circular antenna array 2 is shown; the array could also be cylindrical, spherical or other preferably non-linear/non-planar geometric configurations. The array consists of twelve passive radiating/receiving antenna elements 4 that are conceptually organized into three 120° sectors A, B and C of four passive antenna elements each.

Four active T/R modules TR1, TR2, TR3 and TR4 are provided, one for each passive antenna element 4 in a given sector. The T/R modules TR1–TR4 are associated with single respective antenna elements in each sector. The modules can be switched between the various sectors by means of three-way switches S1, S2, S3 and S4. S1 switches module TR1 between its associated passive antenna elements in each sector, switch S2 switches module TR2 among its associated antenna elements, and so forth. Each switch is within its respective active T/R module (but could alternatively be implemented outside the module), so that the module's inputs/outputs can be switched among conductive leads 6 to/from its associated antenna elements 4 in each sector. All of the leads 6 are preferably equal in length to prevent undesired phase delays.

The entire circumference of the radar system is shown occupied by passive antenna elements, but this is not necessary if less than 360° coverage is desired. The selection of 120° sectors is arbitrary, and other sector sizes such as 90° might also be used. The size of the selected sector determines the switching requirements. Whereas 120° sectors require three-way switches, 90° sectors would use four-way switches (unless the number of active T/R modules used is greater than the minimum number required and some active T/R modules are not associated with antenna elements in all sectors). Other variations, such as organizing the array into sectors with varying arc lengths or connecting different T/R modules to different numbers of antenna elements, are also possible.

Figure 2:
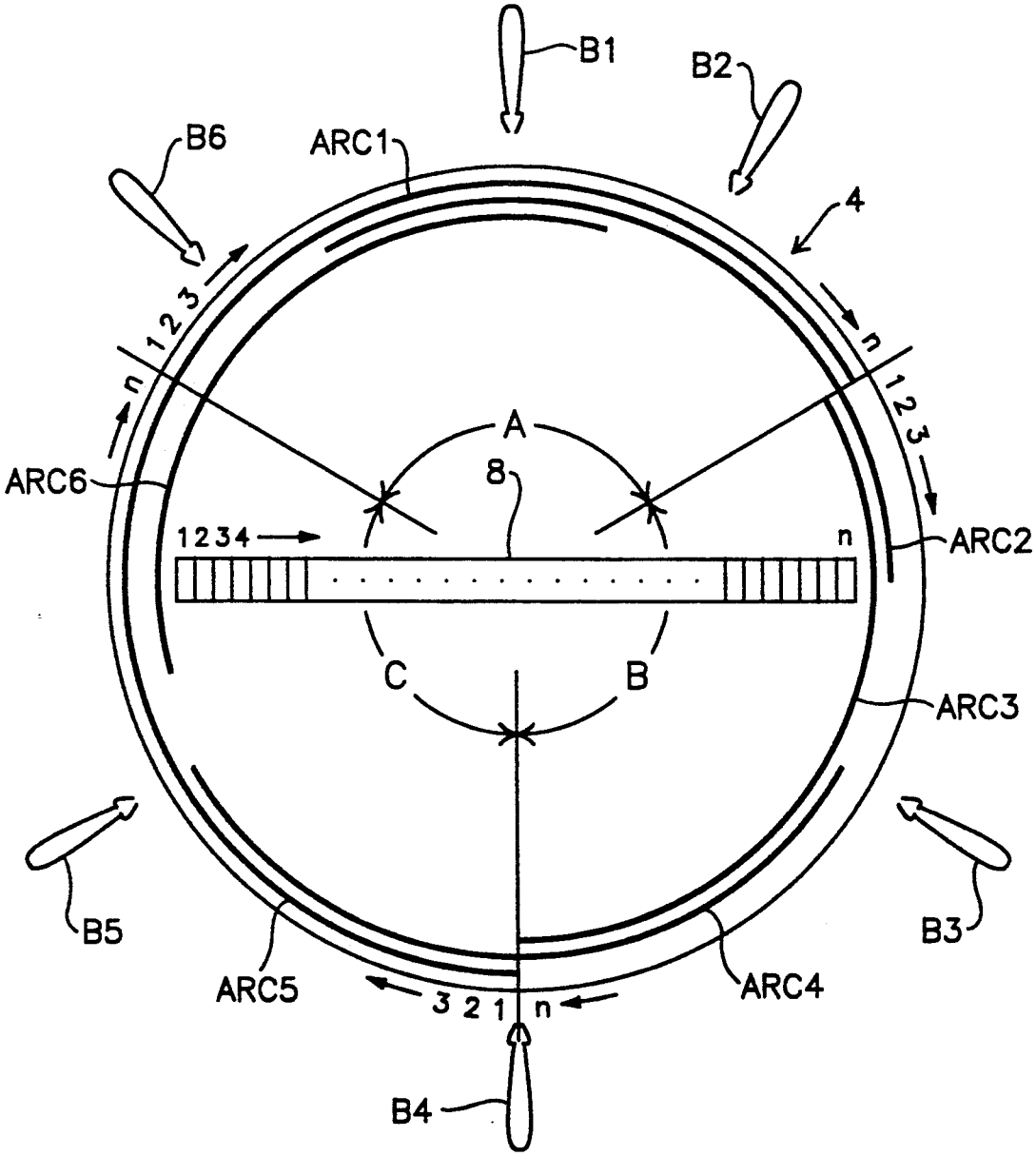
FIG. 2 is a diagram illustrating the organization of passive antenna elements into sectors, and the formation of desired beams by activating selected patterns of individual antenna elements.

The operation of the radar system is illustrated in FIG. 2, in which both the number of both active T/R modules and the number of passive antenna elements per sector have been increased to an arbitrary value n. The T/R modules are shown disposed in a linear or planar array 8, while the passive antenna elements are shown as being organized into a ring with the same 120° sectors A, B and C as in FIG. 1. The passive antenna elements of the ring are numbered 1, 2, 3 . . . n, in a clockwise direction, within each sector. The first T/R module is connectable to ring element 1 in either sector A, B or C, the second T/R module is connectable to ring element 2 in the same sectors, and so on. The minimum number of active T/R modules is one-third of the number of passive antenna elements in the total ring. The connection of each T/R module to one of its associated passive antennas in the various sectors, through its associated switch (not shown in FIG. 2), is determined by the desired direction for the main beam of the array.

To form or receive a beam, a particular pattern of passive antenna elements is connected to heir associated T/R modules. In general, the selected antenna elements will be adjacent to each other, but there may be exceptions. Also, selected individual antenna elements may be activated if desired.

Several examples of the formation of beams will now be described. Beam B1, which is centered on sector A, is formed by connecting each active T/R module to its corresponding antenna element in sector A. This array of antenna elements is indicated by curved line ARC1. Since each active T/R module has internal phase shifting capability, the antenna elements in sector A could also be phase scanned if desired. Beam B2, which is 30° clockwise from beam B1, is formed by connecting the first n/4 active T/R modules to their corresponding antenna elements in sector B (disconnecting them from the same number of antenna elements in sector A), and keeping the remaining active T/R modules connected to the antenna elements in sector A used to form beam B1. The phase shifters in the T/R modules switched to sector B are adjusted to provide the proper relationship to the antenna elements remaining active in sector A, and phase scanning is still possible with the new set of connections as desired. The activated antenna elements to form beam B2 are labeled ARC2.

Continuing around the array, beam B3 is directed along the middle of sector B. It is formed by activating each of the antenna elements in sector B, indicated by ARC3. Beam B4 is halfway between sectors B and C, and is formed by activating the first n/2 antenna elements in sector C and the last n/2 antenna elements in sector B, along ARC4.

Continuing around the array, beam B5 emanates from the mid-point of sector C, and is formed by activating all of the antenna elements in that sector along ARC5. Finally, beam B6 is centered 15° into sector A from sector C. It is formed by activating the last 3n/8 passive antenna elements in sector C and the first 5n/8 antenna elements in sector A, along ARC 6.

The beam shape and power can be varied by changing the of activated antenna elements. For example, if antenna elements along arcs of less than 120° are activated, the beam will tend to be narrower and less powerful. The movement of the beam around the circular antenna array is a function of how many antenna elements are switched from one sector to the next. A full 180° shift in pointing can be accomplished in a single switching procedure, or the beam can be progressively rotated as fast or as slow as desired.

Figure 3:
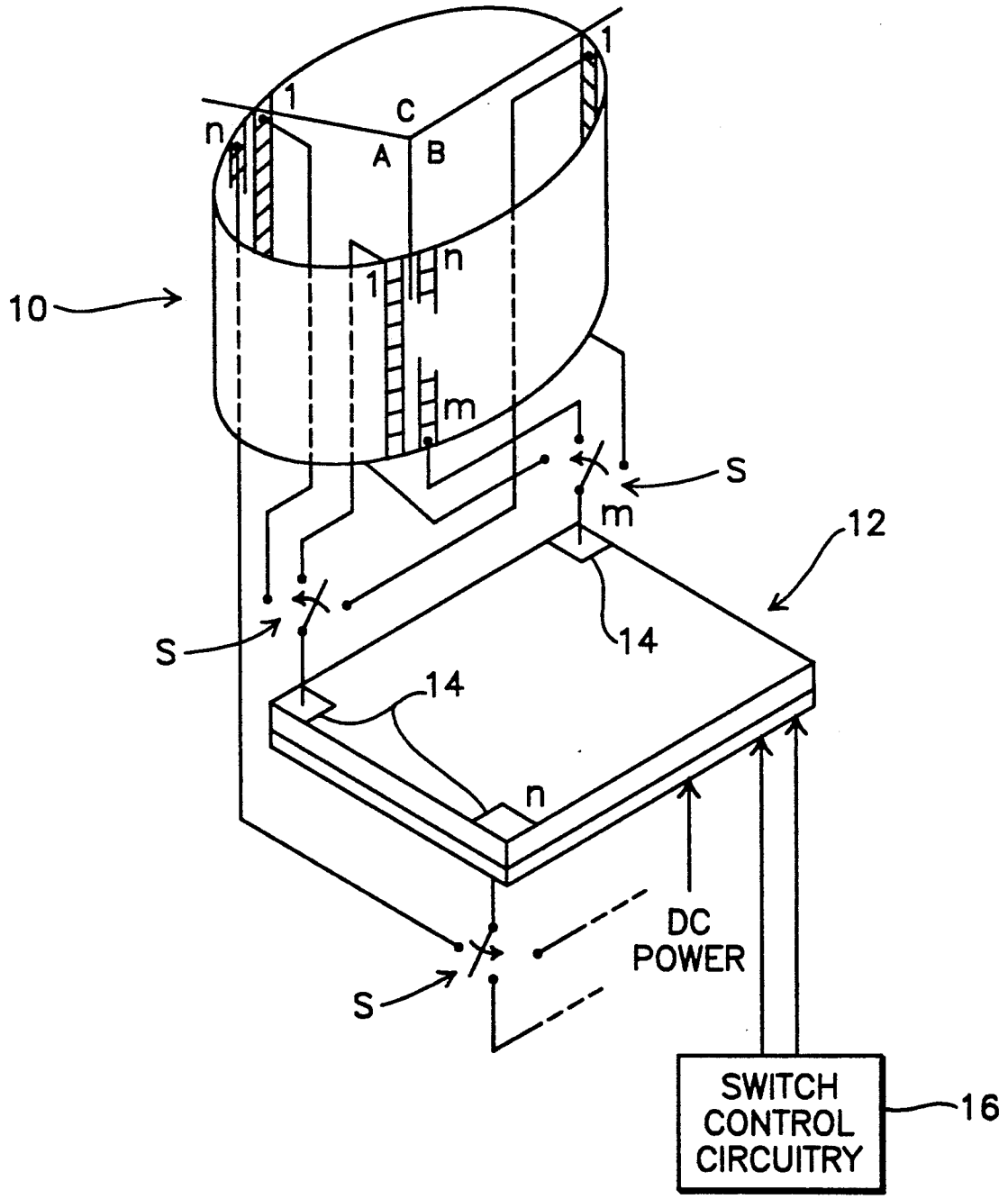
FIG. 3 is an illustrative perspective view showing the application of the invention to a cylindrical antenna array.

The two-dimensional ring designs illustrated in FIGS. 1 and 2 can easily be extended to three-dimensional arrays, such as the cylindrical array 10 in FIG. 3. The cylindrical array 10 is illustrated as having 120° sectors. M rings of antenna elements, each with n elements, extend around the circumference of the array. Alternately, the antenna elements may cover only a portion of the cylinder's surface.

The active T/R modules used to activate selected sets of antenna elements may be implemented as a planar array of modules 12 of dimensions $n \times m$, which may be located outside the volume enclosed by the cylindrical array. Within each ring 1, 2, 3 . . . m, there is an active T/R module 14 for each of the 1-n antenna elements in each sector. Thus, the T/R module in column n, row 1 of the module array 12 is connectable to the passive antenna elements in the column n, row 1 position of each sector A, B and C, and so forth. Switching between each active T/R module and its associated antenna elements is accomplished by means of single-pole, triple-throw switches S contained within each module of the type illustrated in FIG. 1. Again, an alternate implementation could have the switches outside the module. Switch control circuitry 16 controls the switching between the active T/R modules and their associated antenna elements, as described in further detail below. Appropriate conductive feedthroughs extend through the cylinder to connect the antenna elements with the active T/R modules. The conductive paths between the various active T/R modules and their respective antenna elements are preferably equal lengths.

With the arrangement of FIG. 3, an entire sector consisting of n columns and m rows of passive antenna elements in the cylindrical antenna array can be activated at any given time. Beam positioning is controlled as a function of the T/R module to antenna element connections, as described in connection with FIG. 2. Beam positioning in elevation is achieved by phase scanning with the phase shifters in each active T/R module.

Figure 4:
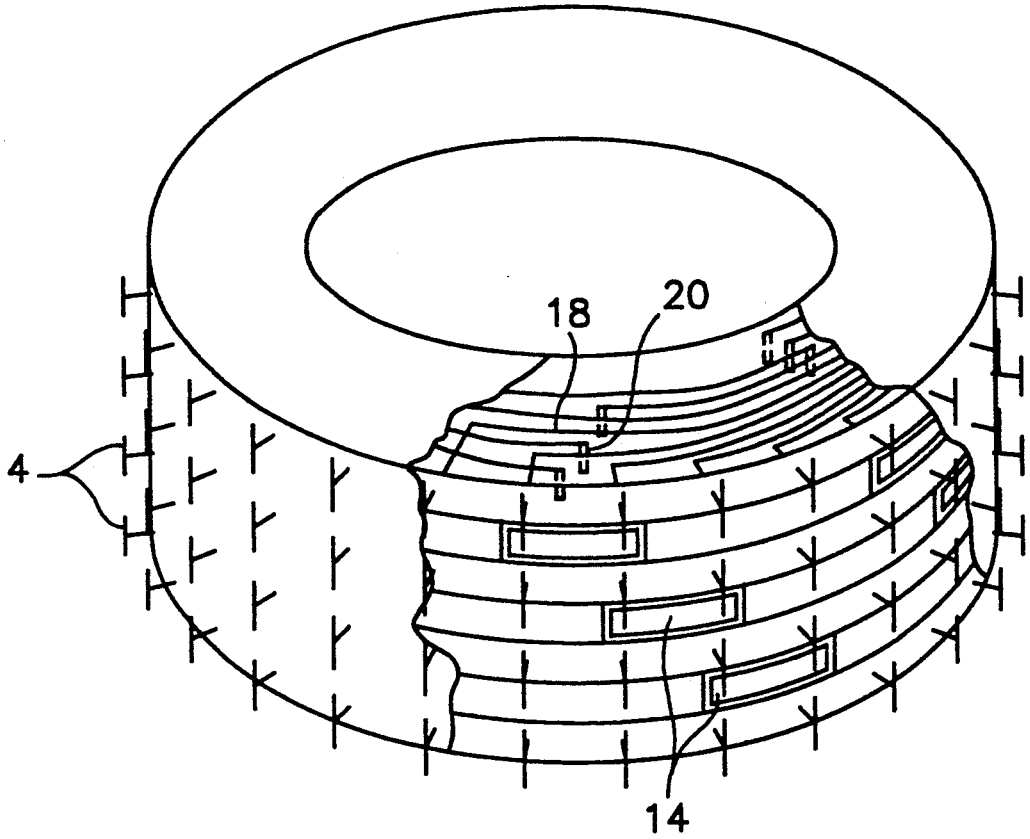
FIG. 4 is a partially broken away perspective view of a compact cylindrical array that uses the invention.

The exact shape and configuration of the active T/R module array is not restricted to the planar array of FIG. 3. FIG. 4 illustrates the incorporation of active T/R modules 14 into a totally cylindrical structure. The system is divided into alternating cylindrical layers of passive antenna elements 4 and active T/R modules 14, with the antenna elements and T/R modules located along the outer portions of their respective layers. Each layer of antenna elements is divided into sectors as described previously, and is controlled by the active T/R modules in the layer immediately below (or above). Annularly routed low-loss RF stripline transmission connectors 18, corresponding to lead line 6 of FIG. 1, extend in arcs within the interior of either the active T/R module of the passive antenna element layers. Conductive interlayer feedthroughs 20 complete the transmission paths between each active T/R module and its respective passive antenna elements. The result is a modular type of construction that conserves volume, in addition to the savings in weight and cost over prior radar configurations. While the active T/R modules are shown in layers that are sandwiched between the layers of antenna elements, different configurations for the T/R modules could also be used, such as placing them on a separate concentric cylinders.

Figure 5:
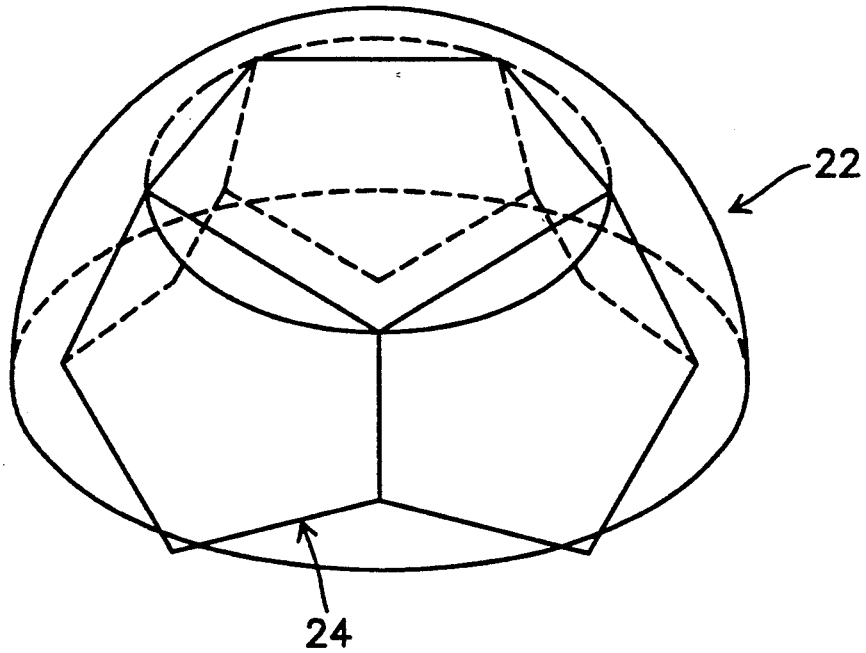
FIG. 5 is an illustration of a hemispherical array of generally pentagonally shaped sectors using the invention.

Many other geometric designs are possible for the arrays of antenna elements. FIG. 5 shows a hemispherical array 22, superimposed over the upper portion of a dodecahedron 24. A dodecahedron is the largest polyhedron that can be perfectly enclosed by a sphere. By placing passive antenna elements on the spherical surface and dividing them into surface sectors that are subtended by the vertices of the dodecahedron, the activation of the antenna elements can be associated with the pentagonal faces of the dodecahedron. Thus, for a hemispherical antenna which conceptually encompasses six pentagons of a dodecahedron, a pentagonal array of active T/R modules can be provided. Separate six-way switches associated with each active T/R module would switch the modules between corresponding passive antennas elements on each of the six surface sectors. The entire array of active T/R modules can be switched from one projected pentagonal surface to another, with phase scanning used to move the beam over lesser excursions. Alternately, through a complex twisting and rotation of the dodecahedron and mapping to the spherical surface, beam positioning in small steps as a function of only module-to-antenna element connections could be achieved. Numerous other geometries such as whole or partial portions of a prolate spheroid or an ellipsoid which has been truncated at its opposite poles, may also be envisioned. Wedges or slices of these or other larger geometries might also be used.

Figure 6:
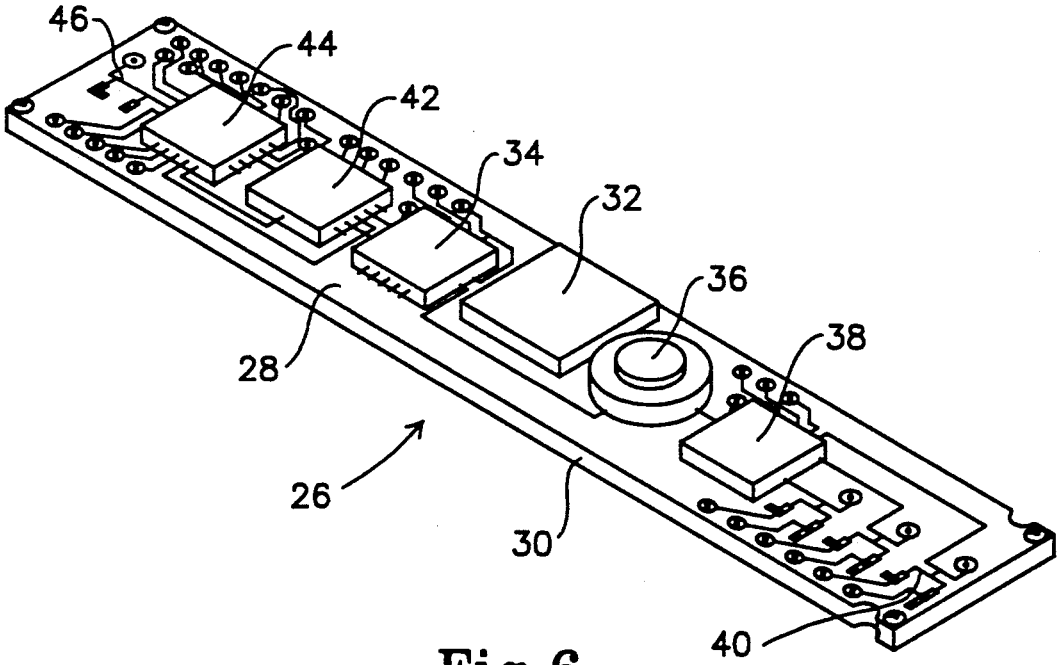
FIG. 6 is a perspective view of an active T/R module with an added switching mechanism.

Active T/R modules are well known, and are described for example in "6 to 18 $GH_z$ Transmit/Receive Modules for Multifunction Phased Arrays", D. E. McHarry, J. L. Bogeau, W. J. Coughlin and M. A. Priolo, 1989 *IEEE MTT-S International Microwave Symposium Digest, Vol. I.* A typical module 26 is pictured in FIG. 6. It is formed on a circuit board 28 which surmounts an aluminum carrier 30. The module includes a power field effect transistor (FET) 32 and a driver amplifier 34 that provide a transmission capability. The output is transmitted through a circulator 36, used to switch between transmit and receive modes, to a single-pole, multi-throw switch 38 used to couple the active T/R module to its associated passive antenna element that is selected at any particular time. The switch is connected to the associated antenna elements by output coupler circuitry 40 for both the transmit and receive modes.

Switch 38 is normally a PIN diode switch that is compatible with GaAs circuitry. Its switching rate is generally on the order of a microsecond or less, depending upon the signal levels and bandwidth. Other switch configurations, such as electro-optic laser switches, might also be used. In theory the switches can be used to cycle each active T/R module through a large number of associated passive antenna elements, but in practice more than 5 or 6 throw positions can limit the switching speed and bandwidth capabilities, and consume excessive power.

In the receive mode, the module can be used either for tracking or locating a target. A low noise amplifier/buffer 42 functions as the front end of the receiver, providing initial amplification to a received signal. Its output is delivered to a programmable phase shifter 44, and then to the receiver (shown in FIG. 7). Programmable phase shifter 44 operates in both transmit and receive modes, establishing the phase of the T/R module output relative to the phases of the other modules to form a desired beam. It operates under control signals received from a data coupler 46.

Figure 7:
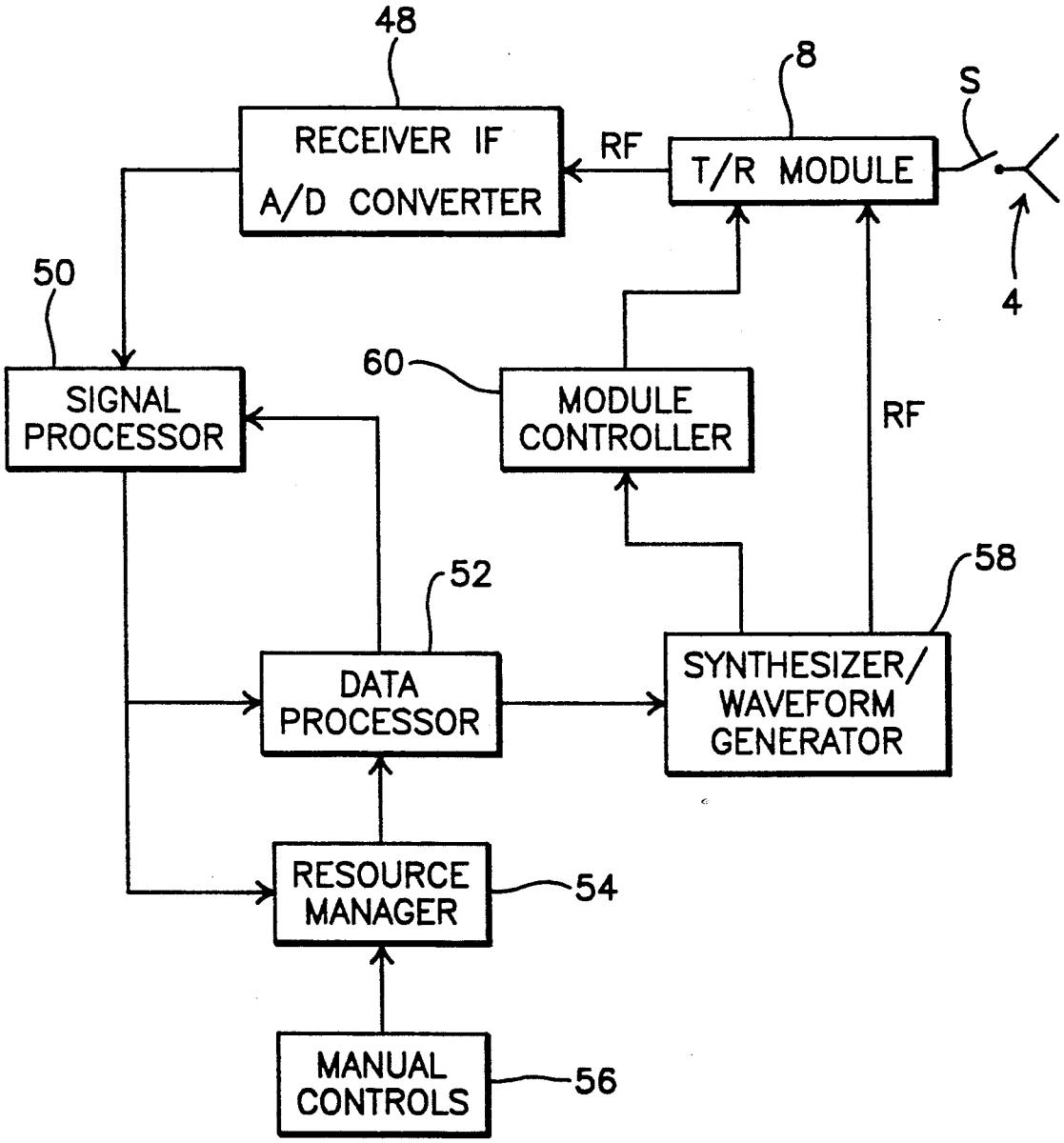
FIG. 7 is a block diagram of a switch control system for interconnecting the T/R modules with the passive antenna elements.

A control mechanism for the radar system described thus far is shown in FIG. 7. Control of the radiated beam position is usually an automatic function of the mode chosen for the radar or communication system. An incoming signal is received by the passive antenna elements 4, transmitted through switches S to their associated active T/R modules 8 for amplification, and then converted to intermediate frequency (IF) and digitized in receiver 48. The characteristics of the incoming signal are analyzed by a signal processor 50, with the assistance of a data processor 52 that normally performs the more routine and repetitive mathematical processes. Items of interest are located and tracked in a conventional manner, with pertinent parameters such as range, velocity, bearing, etc. forwarded to the data processor 52 and a resource manager 54.

The resource manager 54 accepts the automatic inputs from the signal processor 50, and also manual inputs from an operator console 56. Based upon criteria that have been specified in advance for evaluating its inputs, the resource manager 54 establishes priorities in time and antenna beam positioning for the next reception or transmission.

The prioritized timing and positioning commands are sent to the data processor 52, which performs computations to establish which passive elements of the antenna array are to be utilized, precisely when, and for how long. These results are forwarded to a synthesizer/-waveform generator 58 for encoding as a command signal to a module controller 60, and for generation of the appropriate RF waveform for delivery to the T/R module 8.

The module controller 60 converts the beam positioning commands to phase shifter settings and module-to-antenna element switching commands, depending upon its stored association of modules with antenna array elements. This function is provided for both reception and transmission beam positioning.

The present invention is applicable to non-linear/-non-planar array antennas used for both monostatic or bistatic radar systems (monostatic refers to the radar source and receiver being located in the same position, while bistatic refers to the source and receiver being located at different positions), communications systems, and through frequency extension to optical systems used in the above applications, or for angular measuring systems such as those used in precision manufacturing or in astronomy.

While particular embodiments of the invention have been shown and described, numerous variations and alternate embodiments will occur to those skilled in the art. Accordingly, it is intended that the invention be limited only in terms of the appended claims.

I claim:

1. An electromagnetic beam formation and transmission reception system, comprising:

an array of passive radiating/reception elements, a plurality of active transmission/reception (T/R) modules for generating and receiving signals within a desired portion of the electromagnetic spectrum, means for connecting each of said active T/R modules to respective pluralities of mutually spaced passive radiating/reception elements within said array.

switch means controlling the connection of said active T/R modules to their respective passive radiating/reception elements so that at any given time said plurality of T/R modules are collectively connected to a subarray of said radiating/reception elements, switch control means controlling said switch means to sequentially alter the connections between said active T/R modules and their respective passive radiating/reception elements, said switch control means scanning said alteration of connections among said active T/R modules so that successive subarrays of said radiating/reception elements are connected to said T/R modules with each subarray overlapping the next successive subarray by a predetermined number of radiating/reception elements, and means for varying the number of radiating/reception elements in the overlap between said subarrays and thereby vary the subarray scanning rate.

2. The system of claim 1, wherein said switch control means controls said switches to connect said active T/R modules with successive subarrays of mutually adjacent passive radiating/reception elements.

3. An electromagnetic beam transmission/reception system, comprising:

an array of passive radiating/reception elements arranged in a plurality of sectors, a plurality of active transmission/reception (T/R) modules for generating and receiving signals within a desired portion of the electromagnetic spectrum, means for connecting each of said active T/R modules to respective passive radiating/reception elements in each sector, switch means controlling the connection of each active T/R module to its respective passive radiating/reception elements so that it is connected to a radiating/reception element in only one sector at a time, and so that said active T/R modules are collectively connected to a variable subarray of passive radiating/reception elements, switch control means controlling said switch means to scan said subarray among said passive radiating-/reception elements so that said active T/R modules are connected to successive overlapping subarrays of said passive radiating/reception elements, with a predetermined number of radiating/reception elements within the overlaps between successive subarrays, and means for varying the number of radiating/reception elements in said subarray overlaps and thereby vary the subarray scanning rate.

4. The system of claim 3, wherein said passive radiating/reception elements are arranged in a plurality of non-linear, regularly defined loci which constitute repetitive, integral parts of said sectors, and a set of active T/R modules is provided for each such loci of passive radiating/reception elements.

5. The system of claim 4, wherein the active T/R modules are located within a volume defined by said arrangement of passive radiating/reception elements.

6. The system of claim 5, wherein said passive radiating/reception elements and their respective active T/R modules are arranged in alternating spatial layers.

7. The system of claim 6, wherein said layers are generally annular, with said passive radiating/reception elements and active T/R modules positioned along the outer portions of their respective layers, and said connecting means located in the interior portions of said layers.

8. The system of claim 7, wherein said connecting means include conductors that are connected to respective passive radiating/reception elements and which extend to positions associated with their respective active T/R modules along paths that include conductive interlayer feedthroughs, said paths defining substantially equal length connections between said active T/R modules and their respective passive radiating-/reception elements.

9. The system of claim 4, wherein the active T/R modules are located outside of a volume defined by said arrangement of passive radiating/reception elements.

10. The system of claim 9, wherein said connecting means include conductors that are connected to respective passive radiation/reception elements and which extend to respective active T/R modules along paths that define substantially equal length connections.

11. The system of claim 3, wherein said passive radiating/reception elements are arranged in a plurality of layers, and a set of active T/R modules is provided for each layer.

12. The system of claim 11, wherein said passive radiating/reception elements and their respective active T/R modules are arranged in alternating layers.

13. The system of claim 12, wherein said layers are generally annular, with said passive radiating/reception elements and active T/R modules positioned along the outer portions of their respective layers, and said connecting means located in the interior portions of said layers.

14. The system of claim 13, said connecting means including conductors connected to respective passive radiating/reception elements and extending in arcs to positions aligned with their respective active T/R modules, and conductive interlayer feedthroughs for said conductors between said active T/R module and said passive radiating/reception element layers.

15. The system of claim 3, wherein said switch control means controls said switches to connect said active T/R modules with successive subarrays of mutually adjacent passive radiating/reception elements.

16. A method of scanning through an array of passive electromagnetic radiating/reception elements, comprising:

connecting a plurality of active transmission/reception (T/R) modules to a subarray of respective passive radiating/reception elements within said array, said subarray comprising generally adjacent passive radiating/reception elements, repeatedly reconnecting at least one T/R module connected to the passive radiating/reception elements at one end of said subarray to the passive radiating/reception elements adjacent the opposite end of said subarray while keeping the connections for the other T/R modules fixed, thereby repeatedly advancing the radiating/reception elements included in said subarray to scan said subarray through said array of passive radiating/reception elements in a successive series of overlapping subarrays, and varying the number of radiation/reception elements in successive reconnections to vary the subarray scanning rate.

17. The system of claim 1, further comprising means for changing the number of radiation/reception elements in said subarray to alter the shape of a beam transmitted from said array.

18. The system of claim 3, further comprising means for changing the number of radiation/reception elements in said subarrays to alter the shape of a beam transmitted from said array.

19. The method of claim 16, further comprising the step of changing the number of radiation reception elements in said subarray to alter the shape of a beam transmitted from said array.

* * * * *